US005683267A

United States Patent [19]

Ribbeck et al.

[11] Patent Number: 5,683,267

[45] Date of Patent: Nov. 4, 1997

[54] ELECTRICAL CONTACT ELEMENT

[75] Inventors: Horst Ribbeck, Wuppertal; Heinz Ungermann, Linsengericht, both of Germany

[73] Assignee: Stocko Metallwarenfabriken Henkels & Sohn GmbH & Co., Wuppertal, Germany

[21] Appl. No.: 619,986

[22] Filed: Mar. 21, 1996

[30] Foreign Application Priority Data

Mar. 24, 1995 [DE] Germany ..... 295 04 996 U

[51] Int. Cl.[6] ..... H01R 4/24

[52] U.S. Cl. ..... 439/395; 439/397; 439/850

[58] Field of Search ..... 439/395, 396, 439/397, 398, 404, 405, 849, 850

[56] References Cited

U.S. PATENT DOCUMENTS

| | | | |
|---|---|---|---|
| 3,757,284 | 9/1973 | Klehm, Jr. . | |
| 4,527,857 | 7/1985 | Hughes et al. | 439/397 |
| 5,145,422 | 9/1992 | Fry | 439/856 |
| 5,342,226 | 8/1994 | Hayes et al. | 439/845 |

FOREIGN PATENT DOCUMENTS

| | | |
|---|---|---|
| 0416306 | 3/1991 | European Pat. Off. . |
| 0618644 | 10/1994 | European Pat. Off. . |
| 48997 | 2/1965 | German Dem. Rep. . |
| 3812509 | 12/1989 | Germany . |

*Primary Examiner*—J. J. Swann
*Attorney, Agent, or Firm*—Robert W. Becker & Assoc.

[57] ABSTRACT

An electrical contact element has an elongate three-dimensional body formed of a single stamped sheet metal piece and has a first end and a second end with a longitudinal center line extending from the first to the second end. The first end of the body has an insulation displacement contact with a first and a second pair of legs for receiving and contacting a cable. Each one of the first and the second pairs has an insertion slot defined between the legs. The second end of the body has a forked spring with a first and a second fork leg defining therebetween a receiving slot for receiving and contacting a flat blade plug. Each one of the fork legs consists of two independently elastically deflectable leaf springs. Each one of the leaf springs has at least one contact zone projecting inwardly into the receiving slot. The contact zones of the two leaf springs of each one of the fork legs are located laterally relative to the longitudinal center line.

3 Claims, 3 Drawing Sheets

ELECTRICAL CONTACT ELEMENT

BACKGROUND OF THE INVENTION

The present invention relates to an electrical contact element to be arranged in a chamber of a housing and formed from a single stamped sheet metal piece. The electrical contact element comprises an insulation displacement contact with two pairs of legs for receiving and contacting a cable in the respective insertion slots and also comprises a forked spring defining between its fork legs a receiving slot for contacting a flat blade plug.

Such an electrical contact element is, for example, known from European patent 0 416 306. This known electrical contact element has at one end thereof an insulation displacement contact for securing thereat an electrical lead in insulation displacement technique between the elastically deformable clamping and cutting legs. The other end of the contact element has a forked spring for receiving between the fork legs the contact pins of a plug of an electrical plug in connection for achieving electrical contact. In order to ensure a safe contacting between the fork legs and the inserted contact pins of the plug, the fork legs are provided with contact zones extending inwardly into the receiving slot. These contact zones in the form of stamped projections provide, in general, a good contacting between the forked spring and the inserted contact pin of a plug. However, especially when using flat blade plugs it is possible that the contact zones in the plugged-in state are positioned in the area of the snap-in opening of the flat blade plug so that no sufficiently secure electrical contact is provided.

It is therefore an object of the present invention to improve an electrical contact element such that it provides for a secure contacting between the fork legs and the inserted contact pin of a plug.

SUMMARY OF THE INVENTION

The electrical contact element according to the present invention is primarily characterized by:

An elongate three-dimensional body formed of a single stamped sheet metal piece and having a first and a second end with a longitudinal center line extending from the first to the second end;

The first end of the body comprising of an insulation displacement contact with a first and a second pair of legs for receiving and contacting a cable, wherein each one of the first and the second pairs has an insertion slot defined between the legs;

The second end of the body comprising a forked spring with a first and a second fork leg defining therebetween a receiving slot for receiving and contacting a flat blade plug;

Each one of the fork legs comprised of two independently deflectable leaf springs;

Each one of the leaf springs having at least one contact zone projecting inwardly into the receiving slot; and The contact zones of the two leaf springs of each one of the fork legs located laterally relative to the longitudinal center line.

Advantageously, the contact zones of the two leaf springs of at least one of the fork legs are staggered relative to one another in the longitudinal direction of the body.

Preferably, the contact zone of a first one of the two leaf springs is a point contact surface and the contact zone of the other one of the two leaf springs is a linear contact surface.

In a preferred embodiment of the present invention the contact zones of the leaf springs arranged opposite one another have identical contact surfaces.

According to the present invention, the fork legs are comprised of two independently elastically deflectable leaf springs whereby each one of the leaf springs is provided with at least one contact zone projecting inwardly into the receiving slot. The contact zones of the two leaf springs of the fork legs are positioned laterally relative to the longitudinal center line of the electrical contact element.

By embodying the fork legs in the form of two independently elastically deflectable leaf springs with eccentrically displaced contact zones it is ensured, on the one hand, that the insertion force for inserting a contact pin into the receiving slot between the fork legs is reduced and, on the other hand, when using a flat blade plug with a snap-in opening, a contacting in the area of the snap-in opening is avoided because the snap-in opening of a flat blade plug is centrally arranged at the plug.

According to an advantageous embodiment of the inventive electrical contact element, the contact zones of the two leaf springs of a respective fork leg are staggered in the longitudinal direction of the respective fork leg. Due to this staggered arrangement of the contact zones a secure electrical contacting between the fork legs and the contact pin inserted into the receiving slot is ensured for essentially any type of contact pin.

The reliability of providing a sufficient electrical contact and for preventing edge contacting can be further increased according to a preferred embodiment of the invention when the contact zone of one leaf spring is a point contact surface and the contact zone of the other leaf spring of the same fork leg is a linear contact surface.

For achieving a uniform pressure of the individual leaf springs onto the inserted contact pin, the contact zones of two oppositely arranged leaf springs have expediently the same contact surface shape, i.e., point or linear contact surface.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of a specific embodiment utilizing FIGS. 1 through 3.

Figure 1:
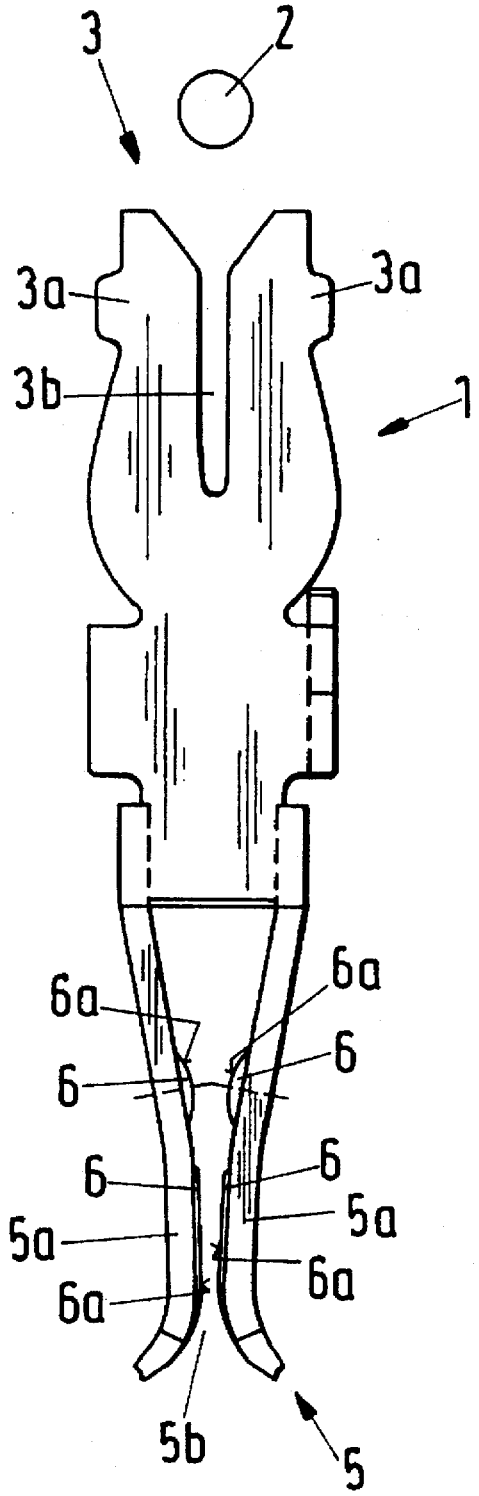
FIG. 1 shows a side view of an electrical contact element.

The electrical contact element represented in FIG. 1 is comprised of a single stamped sheet metal piece from which the body of the electrical contact element is formed by sequential folding steps. From the flat stamped sheet metal piece the electrical contact element 1 which is three-dimensional is produced as is represented in FIGS. 1 to 3.

In order to be able to contact at the electrical contact element 1 an electrical cable 2 in the so-called insulation displacement technique, the electrical contact element is provided with a conventional insulation displacement contact comprised of two parallel cutting and clamping leg pairs 3. Each one of these cutting and clamping leg pairs 3 is comprised of two cutting and clamping legs 3*a* between which an insertion slot 3*b* for the electrical cable 2 is provided.

For contacting the electrical contact element 1 with the contact pin of a plug of an electrical plug-in connection, for example, a flat blade plug 4, the electrical contact element 1 is provided at the end opposite the insulation displacement contact with a forked spring 5. The forked spring 5 is comprised of two fork legs 5*a* which define therebetween a receiving slot 5*b* for the contact pin of a plug. As can be seen in FIGS. 2 and 3, each fork leg 5*a* is comprised of two separate leaf springs 5*c*.

In order to ensure a safe electrical contacting between the fork legs 5*a* and the contact pin inserted into the receiving slot 5*b*, each of the leaf springs 5*c* is provided with inwardly extending contact zones 6 which project into the receiving slot 5*b*, as is shown in FIG. 1.

Figure 2:
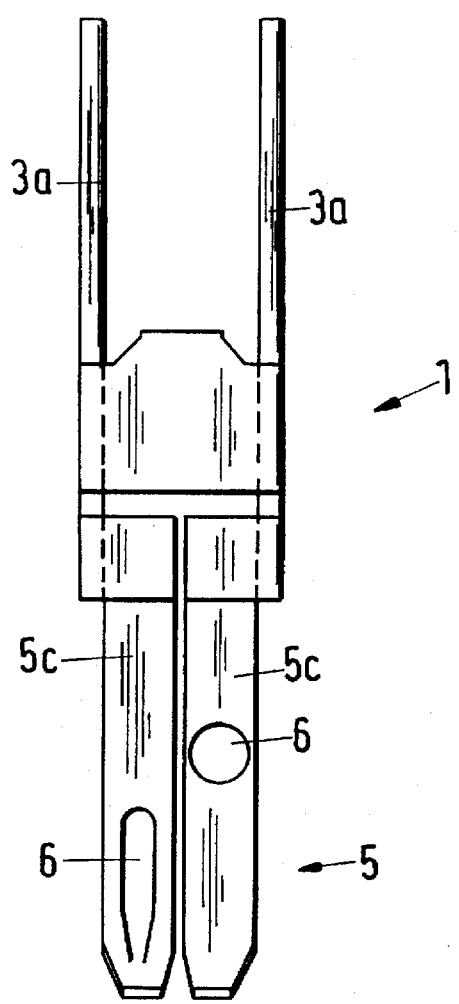
FIG. 2 shows a plan view of the electrical contact element of FIG. 1 with a flat blade plug before mounting.
Figure 2:
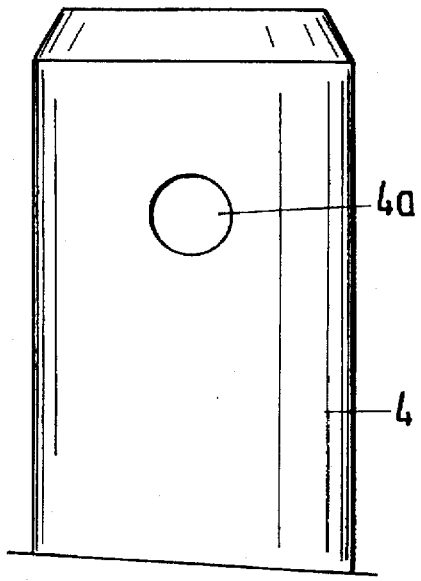
Figure 3:
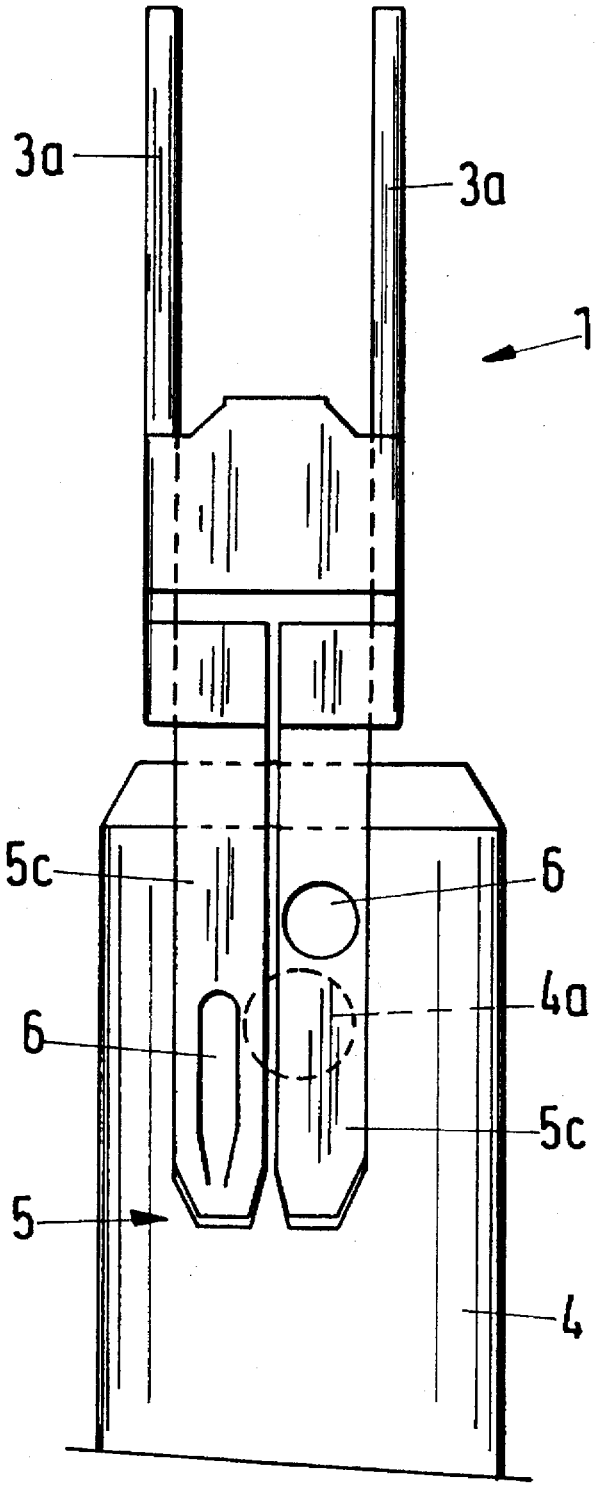
FIG. 3 shows the same electrical element of FIG. 2 with the flat blade plug inserted.

In drawings FIG. 2 and FIG. 3 the contact of an electrical contact element 1 with a flat blade plug 4 is represented. For contacting, the flat blade plug 4 is inserted into the receiving slot 5*b* of the fork spring 5 so that the fork legs 5*a* are bent outwardly. Due to the embodiment of the fork leg 5*a* in the form of individual leaf springs 5*c*, the insertion forces are reduced because the individual leaf springs 5*c*, due to their minimal width, are more elastic than one-part fork legs 5*a*. The contact zones 6 which are provided at the leaf springs 5*c*, preferably by stamping, are staggered in the longitudinal direction of the fork legs 5*a* and are also arranged eccentrically to the longitudinal center line of the contact element 1 whereby the contact zones 6 of the leaf springs 5*c* of each fork leg 5*a* have differently embodied contacting surfaces 6*a*.

The staggered arrangement of the contact zone 6 ensures that for a completely inserted flat blade plug 4 received in the receiving slot 5*b*, as shown in FIG. 3, the contact zones 6 of the fork legs 5*a* are not positioned in the area of the snap-in opening 4*a* of the flat blade plug 4 which would result in an insufficient electrical contacting. As can be seen especially in the embodiment of FIG. 3, the contact zones 6 with their contact surfaces 6*a* are positioned at a distance to the snap-in opening 4*a* of the flat blade plug 4.

With an electrical contact element of the disclosed kind it is possible, on the one hand, to reduce the insertion force for contacting the contact pin and, on the other hand, to ensure that at any time a sufficient electrical contact between the contact zones 6 of the fork legs 5*a* and the inserted contact pin of a plug is provided.

The present invention is, of course, in no way restricted to the specific disclosure of the specification and drawings, but also encompasses any modifications within the scope of the appended claims.

What we claim is:

1. An electrical contact element comprising:

an elongate three-dimensional body formed of a single stamped sheet metal piece and having a first and a second end with a longitudinal center line extending from said first to said second end;

said first end of said body comprising an insulation displacement contact with a first and a second pair of legs for receiving and contacting a cable, wherein each one of said first and said second pairs has an insertion slot defined between said legs;

said second end of said body comprising a forked spring with a first and a second fork leg defining therebetween a receiving slot for receiving and contacting a flat blade plug;

each one of said fork legs comprised of two independently deflectable leaf springs;

each one of said leaf springs having at least one contact zone projecting inwardly into said receiving slot; and said contact zones of said two leaf springs of each one of said fork legs located laterally relative to said longitudinal center line; and wherein said contact zone of a first one of said two leaf springs is a point contact surface and wherein said contact zone of the other one of said two leaf springs is a linear contact surface.

2. An electrical contact element according to claim 1, wherein said contact zones of said two leaf springs of at least one of said fork legs are staggered relative to one another in a longitudinal direction of said body.

3. An electrical contact element according to claim 1, wherein said contact zones of said leaf springs arranged opposite one another have identical said contact surfaces.

* * * * *